US009068329B2

(12) United States Patent
Gransow et al.

(10) Patent No.: US 9,068,329 B2
(45) Date of Patent: Jun. 30, 2015

(54) JET REGULATOR

(75) Inventors: Eckhard Gransow, Froendenberg (DE); Werner Buschey, Bochum (DE)

(73) Assignee: Grohe AG, Hemer (DE)

( * ) Notice: Subject to any disclaimer, the term of this patent is extended or adjusted under 35 U.S.C. 154(b) by 380 days.

(21) Appl. No.: 13/561,481

(22) Filed: Jul. 30, 2012

(65) Prior Publication Data

US 2012/0325928 A1 Dec. 27, 2012

Related U.S. Application Data

(63) Continuation of application No. PCT/EP2011/000351, filed on Jan. 27, 2011.

(30) Foreign Application Priority Data

Jan. 29, 2010 (DE) ..... 10 2010 006 376

(51) Int. Cl.

| | |
|---|---|
| ***E03C 1/084*** | (2006.01) |
| ***B05B 1/16*** | (2006.01) |
| ***B05B 1/30*** | (2006.01) |
| *B05B 1/18* | (2006.01) |
| *B05B 1/34* | (2006.01) |

(52) U.S. Cl.

CPC . *E03C 1/084* (2013.01); *B05B 1/16* (2013.01); *B05B 1/18* (2013.01); *B05B 1/3006* (2013.01); *B05B 1/34* (2013.01)

(58) Field of Classification Search

CPC ..... E03C 1/08; E03C 1/086; E03C 2001/026; B05B 1/202; B05B 1/22; B05B 1/16; B05B 1/18; B05B 1/3006; B05B 1/34; Y10S 261/22

See application file for complete search history.

(56) References Cited

U.S. PATENT DOCUMENTS

| | | | | |
|---|---|---|---|---|
| 3,697,002 | A | | 10/1972 | Parkison |
| 4,000,857 | A | * | 1/1977 | Moen ..... 239/428.5 |
| 4,562,960 | A | * | 1/1986 | Marty et al. ..... 239/72 |
| 5,348,231 | A | * | 9/1994 | Arnold et al. ..... 239/428.5 |
| 2010/0147397 | A1 | | 6/2010 | Zoller |

FOREIGN PATENT DOCUMENTS

| | | | |
|---|---|---|---|
| DE | 43 30 651 | A1 | 3/1995 |
| DE | 44 36 193 | A1 | 4/1996 |
| DE | 198 51 151 | A1 | 5/2000 |
| DE | 20 2007 002 904 | U1 | 5/2008 |
| WO | WO 2008/067903 | A1 | 6/2008 |

* cited by examiner

*Primary Examiner* — Darren W Gorman

(74) *Attorney, Agent, or Firm* — Muncy, Geissler, Olds & Lowe, P.C.

(57) ABSTRACT

A jet regulator for the outlet of a sanitary fitting or for a shower is provided that has at least two flow chambers or flow ducts, each of which has an inlet opening and one or more water outlet openings, the control of the flow to each flow chamber or flow duct is carried out via a valve having a resilient valve body which is arranged upstream of the flow chambers or flow ducts and optionally closes or opens the inlet openings thereof using the resilient valve body, wherein a deformation of the resilient valve body and thus a change in the valve position is carried out by a change in the applied water pressure or by mechanical actuation via an actuating element.

20 Claims, 4 Drawing Sheets

JET REGULATOR

This nonprovisional application is a continuation of International Application No. PCT/EP2011/000351, which was filed on Jan. 27, 2011, and which claims priority to German Patent Application No. DE 10 2010 006 376.2, which was filed in Germany on Jan. 29, 2010, and which are both herein incorporated by reference.

BACKGROUND OF THE INVENTION

1. Field of the Invention

The invention relates to a jet regulator for the outlet of a sanitary fitting or for a shower head.

2. Description of the Background Art

Jet regulators, also called aerators or mixing nozzles, are often located at the water outlet of a sanitary fitting and influence the shape and type of the water jet. Depending on very different country-specific circumstances and different water pressures, the best possible jet is to be assured. Typically, a soft but not spraying jet is to be produced and water and energy costs to be saved. There are jet regulators with an aerated jet, laminar jet, and spray jet.

In the case of a lower water volume, a greater area can be wetted with water by a spray jet having a plurality of individual jets than by a laminar jet. In the case of higher water pressure and greater water volume, a spray jet at a sink is less suitable, because it causes many splashes upon impacting the sink.

German Offenlegungsschrift DE 44 36 193 discloses a jet regulator with a perforated plate by means of which the water jet can be adapted to changing water pressure conditions or water pressure variations, in that openings in the perforated plate can be blocked or unblocked for the flow of water by means of a valve biased in the closed position.

SUMMARY OF THE INVENTION

It is therefore an object of the invention to bring about a functional improvement for sanitary fittings and shower heads with different types of jets.

In an embodiment, the invention provides a jet regulator for the outlet of a sanitary fitting or a shower head, said regulator which comprises at least two flow chambers or flow channels, each of which has an inflow opening and one or more water outlet openings. The control of the inflow of each flow chamber or flow channel can occur via a single valve with an elastic valve body, which is disposed upstream of the flow chamber or flow channels and closes or opens the inflow openings selectively, whereby a deformation of the elastic valve body and thereby a change in the valve position occur by a change in the applied water pressure or by mechanical actuation by means of an actuating element. A closing of the inflow opening of the flow chamber or the flow channel is provided by placing of a part of the elastic valve body against a sealing surface.

A jet regulator typically has a housing with an outer thread, which can be screwed into the outlet of a sanitary fitting. The flow chambers or flow channels are formed by the housing and partition walls, whereby the partition walls can be formed optionally by removable inserts or insert parts in the housing. The flow chambers or flow channels have at their closing end, for example, in the housing bottom, water outlet openings of highly different types or again inserts in the form of sieves or spray plates, which provide for the form of the emerging water jet.

According to an embodiment of the invention, the flow chambers or flow channels are arranged concentrically. Advantageously, the elastic valve body is positioned and designed so that it forms a part of the flow chambers or flow channels. A circular ring shape is especially suitable to this end. The elastic valve body can also be connected form-fittingly to an insert or insert part, which is part of the flow chambers or flow channels or contains a flow channel. In addition, the elastic valve body may have at least one lip or flap. Elastomers, which may also be used according to drinking water guidelines, are especially suitable as the material for the valve body.

Depending on the applied water pressure at which water is to be changed from one to another type of jet, the shape of the valve body and thereby the shape of the lips or flaps, which are to be moved by the applied water pressure, can be shaped differently. The cross sections and the stiffness of the lip or flap as required can be constant or have a step over its length, from the fixing point at the circular ring to the sealing surface. An embodiment of the invention provides, for example, that two lips or flaps each with a different stiffness are provided at the valve body. The circular ring of the valve body forms a partition wall between the flow channels.

The valve body is connected form-fittingly to the insert, so that the lip forms a defined gap.

The sealing surface against which a part of the valve body, one of its lips, or its flaps lies to close the inflow opening of a flow chamber or a flow channel is advantageously formed by a housing wall, or by the inner side of a housing wall of the jet regulator. The sealing surface, however, can also be formed by a centrally disposed insert element, which has, for example, a cylindrical or stamp-like form. The lips or flaps of the valve body are each arranged or attached in such a way that in the open position of the valve a defined gap is formed between the sealing surface and the lip or flap. In the closed valve position, the valve body or a part thereof can lie flat against the sealing surface or can come to lie only with an edge against the sealing surface and thereby close the defined gap.

Depending on the desired type of jet, a spray plate or a sieve can be provided in the water outlet opening of a flow chamber or a flow channel to generate a laminar or mousseur jet. Alternatively, individual water outlet openings, arranged at a distance to one another, can be provided in a flow chamber or a flow channel, so that a spray jet with several individual jets is formed. If inserts or insert parts with water openings or holes are used to create the flow chambers or the flow channels, it is of advantage, when between the insert, which forms or contains a flow channel, and the housing bottom of the jet regulator an elastic sealing element is provided, which has tubular elements, which penetrate the water outlet openings in the housing bottom. The tubular elements act like water outlet nozzles, which create the individual jets for a spray jet. The sealing elements typically are made of an elastomer. Apart from the function of forming the spray jets and metering, they also have a descaling function. Scale deposits from the emerging water on the sealing element or the water outlet nozzles are in fact possible but can be removed by light mechanical action on the tubular elements.

According to an embodiment of the invention, it is to be possible at different applied water pressures, which result either from the position of the check valve or from technical domestic circumstances, to create different spray patterns or spray types automatically, so that in each case the most efficient jet type can be used, for example, for hand washing.

Nevertheless, a large area is to be wetted at a low water pressure, and at a high water pressure splashing upon impacting of the jet is to be avoided.

For this reason, the invention provides a method for jet adjustment in a sanitary fitting with a jet regulator, which is provided in the outlet of the sanitary fitting, or with a jet regulator for a shower head, said regulator which comprises at least two flow chambers or flow channels, each of which has an inflow opening and one or more water outlet openings and in which a valve with an elastic valve body is disposed. With a closed check valve and/or at a water pressure below 2 L/min, an elastic valve body or a part thereof blocks a first inflow opening of a first flow chamber or a first flow channel and simultaneously opens an inflow opening of a second flow chamber or a second flow channel for the inflowing water volume, so that a first jet type, for example, a spray jet with individual jets is formed by the water outlet openings present there. At an increased or increasing water pressure, a deformation of the valve body occurs in such a way that it comes to lie against a sealing surface of the jet regulator and the opened inflow opening of the second flow chamber or the second flow channel is blocked. When a defined limiting pressure is reached, therefore both inflow openings are blocked by the valve body. After a further increase in the water pressure, further deformation of the valve body occurs in such a way that the inflow opening of the first flow chamber or the first flow channel is opened and the inflowing water leaves the sanitary fitting or the shower head through the water outlet opening present there or the water outlet openings and has a second jet form, which can be formed, for example, as a laminar or mousseur jet.

An embodiment of the invention provides that in addition to the automatic or water pressure-dependent jet adjustment, a mechanical jet adjustment is possible. In this regard, the method for jet adjustment in a sanitary fitting with a jet regulator, which is provided in the outlet of the sanitary fitting and which comprises at least two flow chambers or flow channels, each of which has an inflow opening and one or more water outlet openings and in which a valve with an elastic valve body is disposed, provides that the inflowing water, because of a first opened and a second closed lip of the valve body, is introduced through a first inflow opening in the first flow chamber or flow channel and is formed by the water outlet openings present there into a first jet type, for example, a spray jet with individual jets. To adjust the jet type, a deformation of the first opened lip of the valve body is brought about by means of a mechanical actuating element in such a way that it comes to lie against a sealing surface of the jet regulator and blocks the opened first inflow opening. Simultaneously or subsequently, a deformation of the second closed lip of the valve body is brought about by means of movement of the mechanical actuating element in such a way that the inflow opening of the second flow chamber or the second flow channel is opened and the inflowing water flows out through the present water outlet opening or water outlet openings and is formed, for example, into a laminar or mousseur jet.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
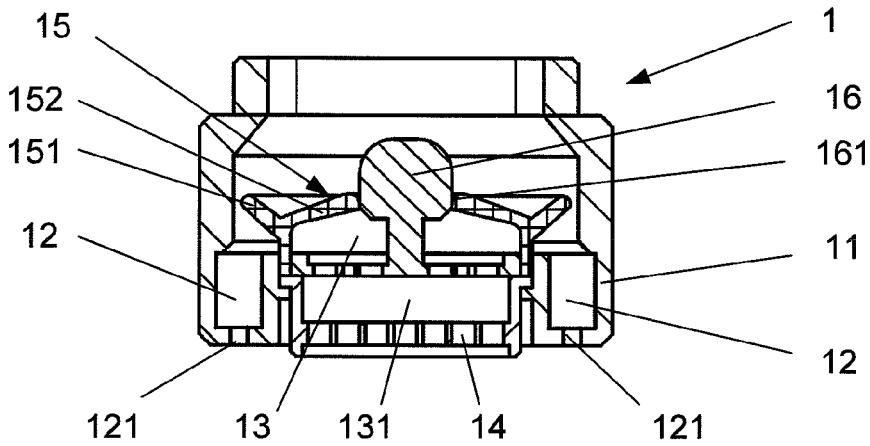
FIG. 1 shows a section through a jet regulator of the invention in a first with a closed check valve or a low applied water pressure.
Figure 2:
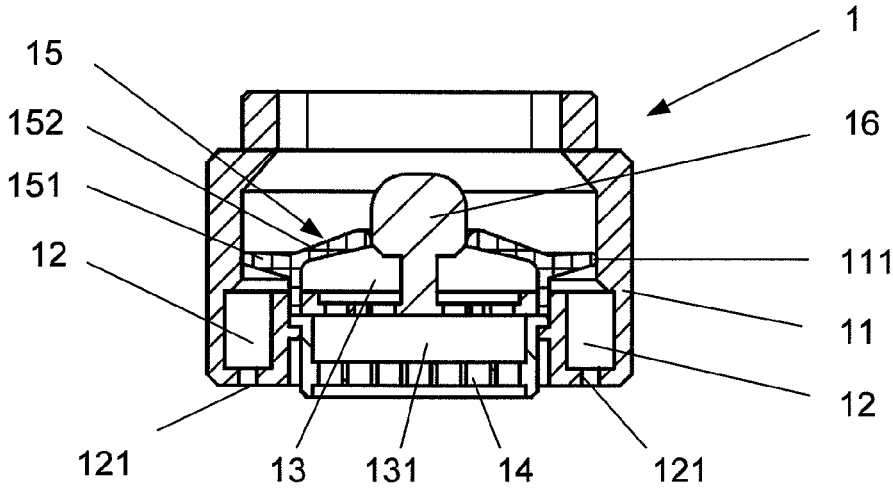
FIG. 2 shows a section through the jet regulator of FIG. 1 at a defined applied limiting pressure.
Figure 3:
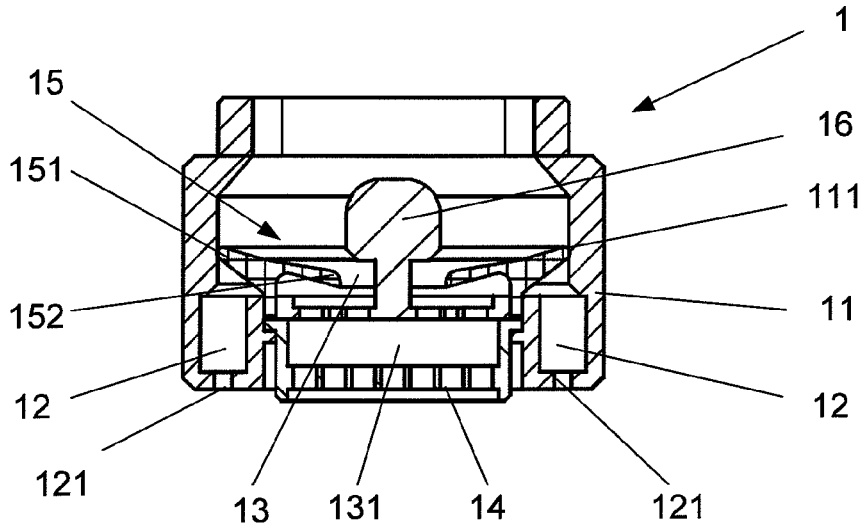
FIG. 3 shows a section through the jet regulator of FIGS. 1 and 2 at an increased water pressure.

FIGS. 1 to 3 show a section through a jet regulator 1 of the invention, with a housing 11, whose outer contour is matched to the outlet of a sanitary fitting and whose inner contour defines a part of a flow chamber or a flow channel 12. The present jet regulator 1 has two flow channels 12, 13, which are arranged concentrically to one another. Provided in jet regulator 1 is a valve with a circular ring-shaped elastic valve body 15, whose open and closed positions are achieved by a deformation of valve body 15 and its interaction with different sealing surfaces 111, 161. Elastic valve body 15 has two differently shaped lips 151, 152, which project to both sides of the valve body. Valve body 15 is inserted into jet regulator 1 through the lower opening of housing 11 and simultaneously forms an extension of a flow channel wall. Next, a stamp-shaped insert 16 is inserted into jet regulator 1 also through the lower opening of the housing, said insert against which a lip 152 of the valve body nestles, thus is biased, and forms a tight shut-off of the resulting flow channel 13 at the inflow opening. Subsequent to stamp-shaped insert 16, a sieve or a spray plate 14 is inserted or screwed downstream into water outlet opening 131 of flow channel 13; a laminar jet or a mousseur jet can be created with the aid of said sieve or plate.

It is evident from FIG. 1 that lip 152 projects freely and opens the inflow opening to flow channel 12. At a low water volume, the water flows through this inflow opening and is shaped by water outlet openings 121 overall into a spray jet with a number of individual jets.

FIG. 2 shows the jet regulator of FIG. 1 at an increased water pressure. The system is adjusted with the geometry of elastic valve body 15 and the associated material properties so that at the shown defined limiting pressure, lip 151 closes in that it comes to lie against a sealing surface 111 of housing 11, whereas lip 152 is still closed.

FIG. 3 shows the jet regulator of FIG. 2 after a defined increase in the water pressure. Lip 152 is deformed and slides along sealing surface 161 of stamp-shaped insert 16 and frees the inflow opening of flow channel 13. The water thus flows to water outlet opening 131, in which spray plate 14 is inserted and thus serves as a spray plate for a mousseur jet.

Figure 4:
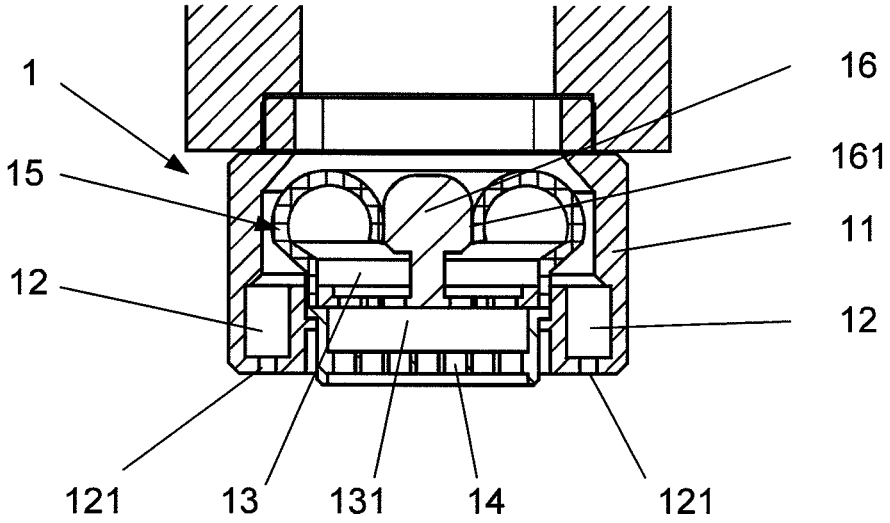
FIG. 4 shows a section through a jet regulator of the invention in a second embodiment with a closed check valve or a low applied water pressure.
Figure 5:
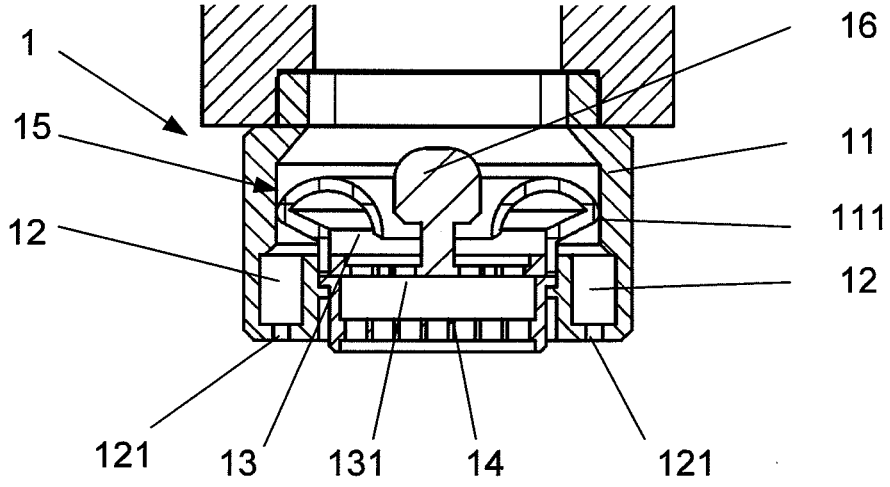
FIG. 5 shows a section through the jet regulator of FIG. 4 at an increased water pressure.

FIGS. 4 and 5 show another exemplary embodiment for a jet regulator 1 of the invention, whose elastic valve body 15 has a different geometry but whose mode of action corresponds to the previously described basic principle.

Figure 6:
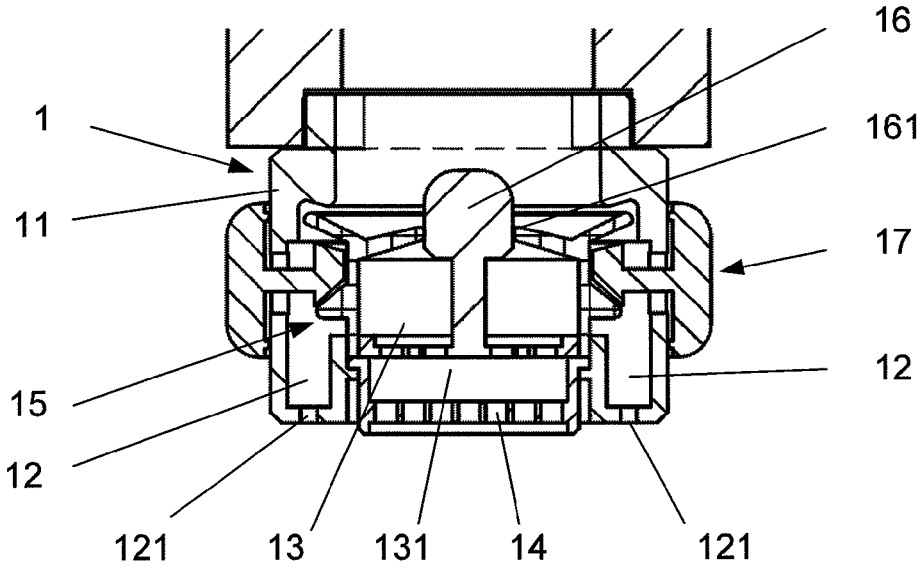
FIG. 6 shows a section through a jet regulator of the invention according to the first embodiment with an additional mechanical actuating element.
Figure 7:
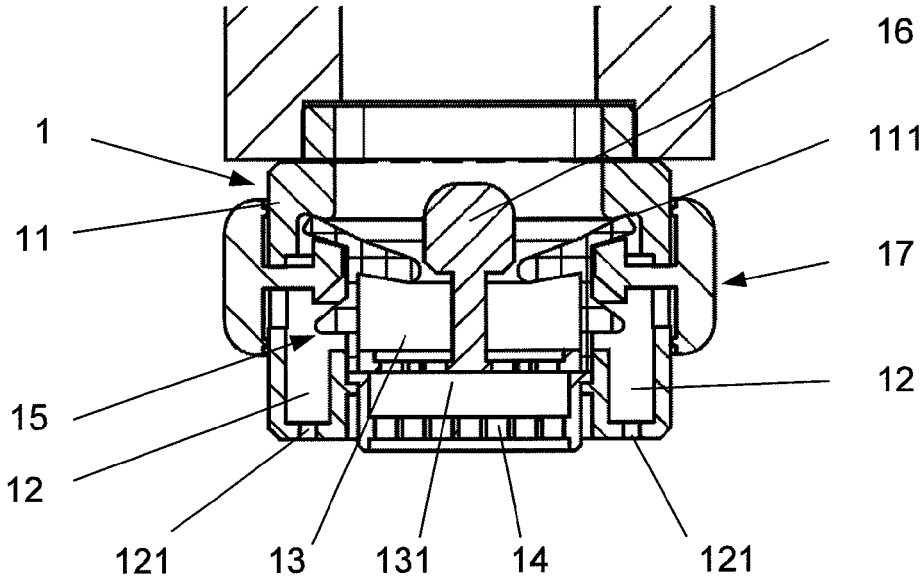
FIG. 7 shows a section through the jet regulator of FIG. 6 with a deformed valve body and a changed position of the actuating element.
Figure 8:
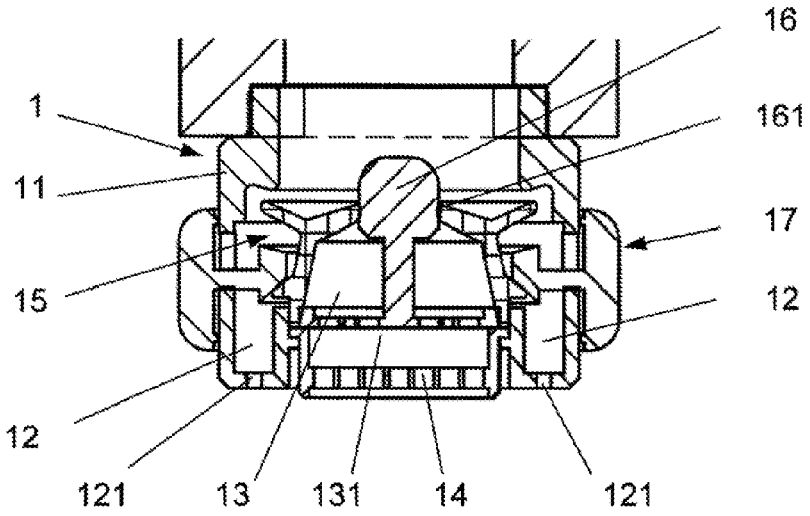
FIG. 8 shows a section through the jet regulator of FIGS. 6 and 7 with a deformed valve body and a changed position of the actuating element.

FIGS. 6 and 7, however, show jet regulator 1 with elastic valve body 15 from FIGS. 1 to 3, whose automatic function of the jet adjustment based on an increase or decrease in the applied water pressure can be expanded by an additional element for blocking the openings in the area of elastic valve body 15. In this regard, the deformation of valve body 15 occurs by means of a mechanical actuating element 17. FIGS. 6 to 8 show mechanical actuating element 17 in the form of an annular valve, which can be actuated from the outside by sliding along the housing. In FIG. 6, the annular valve is in a middle neutral position, so that it has no effect on elastic valve body 15. Lip 152 of valve body 15 is under bias, lies against sealing surface 161 of stamp-shaped insert 16, and closes the inflow opening to flow channel 13. It releases the inflow opening to flow channel 12, however. In this position of mechanical actuating element 17, the mode of action of jet regulator 1 is identical to the embodiment shown in FIGS. 1 to 3.

In FIG. 7, the annular valve is located at an upper stop point. With its interior cam, it presses lip 151 against sealing surface 111 of housing 11, so that the inflow opening of flow chamber 12 is closed and the inflow opening to flow chamber 13 is opened. Thus, the function of the spray jet at jet regulator 1 is blocked.

FIG. 8 finally shows mechanical actuating element 17 in the position in which it deforms valve body 15 in such a way that its lip 152 comes to lie against sealing surface 161 of stamp-shaped insert 16 and thus blocks the inflow opening to flow chamber 13.

Figure 9:
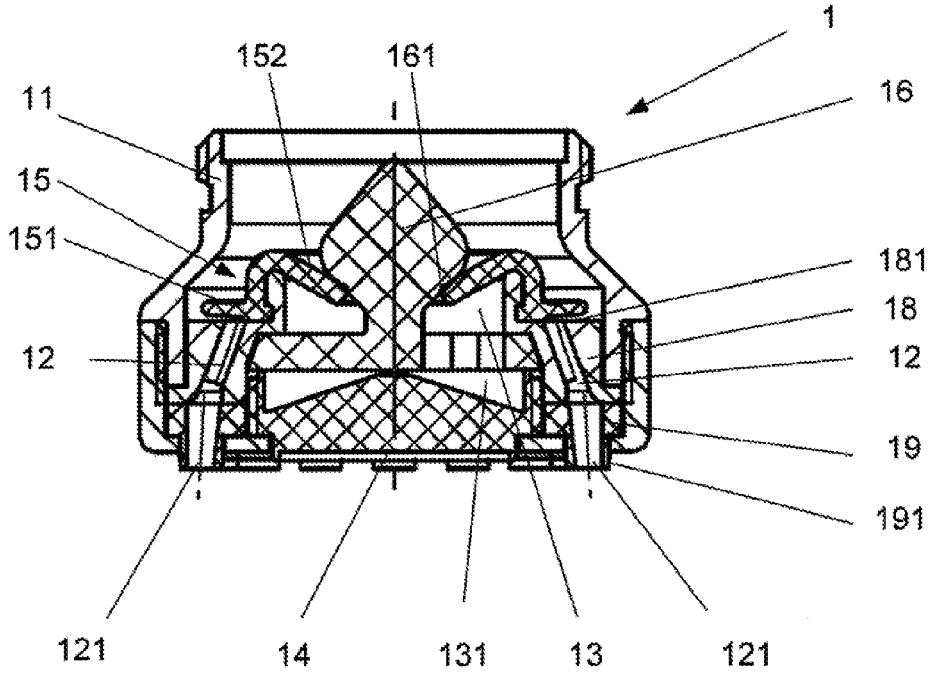
FIG. 9 shows a section through a jet regulator in a third embodiment.

FIG. 9 shows finally a section through a jet regulator 1 of the invention in another embodiment. Housing 11 of jet regulator 1 is also matched to the outlet of a sanitary fitting. Flow chamber 13 and flow channels 12, however, are defined by another insert 18. Ring-shaped insert 18 contains flow channels 12. In this exemplary embodiment, elastic valve body 15 is connected form-fittingly to insert 18. The open and closed positions are achieved here as well by a deformation of valve body 15 and its interaction with different sealing surfaces 161 and 181. To close the opening of flow chamber 13, an edge of lip 152 works together with sealing surface 161 of stamp-shaped insert 16. Second lip 151 of elastic valve body 15 forms a defined gap with sealing surface 181 at insert 18. In the open state, the opening to flow channel 12 in insert 18 is released. At an increased water pressure, lip 152 is lowered and flatly closes the opening of flow channel 12.

The defined gap is closed and lip 151 lies flat on sealing surface 181.

In this jet regulator, during assembly insert 18 with valve body 15 is inserted into jet regulator 1 through the lower opening of housing 11 and simultaneously forms flow channels 12. Next, stamp-shaped insert 16 is also inserted into jet regulator 1 through the lower opening of the housing, said insert against which lip 152 of valve body 15 nestles. Subsequent to stamp-shaped insert 16, a sieve or a spray plate 14 is inserted or screwed downstream into the water outlet opening 131 of flow channel 13; a laminar jet or a mousseur jet can be created with the aid of said sieve or plate.

Before the housing bottom of jet regulator 1 is screwed into its housing, yet another sealing element 19 is inserted, which with its tubular elements 191 penetrates water outlet openings 121 in the housing bottom. Apart from the sealing of insert 18 against the housing of jet regulator 1, sealing element 19 with its tubular elements 191 forms water outlet nozzles, with which the individual jets of a spray jet are formed.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A jet regulator for an outlet of a sanitary fitting or a shower head, the jet regulator comprising:

at least two flow chambers or flow channels, each of which including an inflow opening and one or more water outlet openings;

a valve with an elastic valve body configured to control an inflow of each flow chamber or flow channel, the valve being arranged upstream of the flow chambers or flow channels; and an insert attached within the jet regulator in a fixed, stationary position, an upper portion of the insert protruding through a central opening of the elastic valve body, wherein a closing or an opening of the inflow openings of the flow chambers or flow channels is performed by a deformation of the elastic valve body such that a change in a valve position occurs by a change in an applied water pressure or by mechanical actuation via an actuating element.

2. The jet regulator according to claim 1, wherein the flow chambers or flow channels are arranged concentrically to one another.

3. The jet regulator according to claim 1, wherein the elastic valve body is part of the flow chambers or flow channels.

4. The jet regulator according to claim 1, wherein the elastic valve body is connected form-fittingly to the insert, which is a part of the flow chambers or flow channels or contains a flow channel.

5. The jet regulator according to claim 1, wherein the elastic valve body has a circular ring shape.

6. The jet regulator according to claim 1, wherein the elastic valve body has at least one lip or flap.

7. The jet regulator according to claim 6, wherein a stiffness of the at least one lip or flap is constant or has a step over its length.

8. The jet regulator according to claim 4, wherein the elastic valve body includes two lips or flaps with a different stiffness.

9. The jet regulator according to claim 1, wherein a closing of one of the inflow openings is provided by placing a part of the elastic valve body against a sealing surface.

10. The jet regulator according to claim 9, wherein the sealing surface is formed by a housing wall of the jet regulator.

11. The jet regulator according to claim 9, wherein the sealing surface is formed by a front face of the upper portion of the insert.

12. The jet regulator according to claim 9, wherein the sealing surface is formed by a centrally disposed additional insert element in the jet regulator.

13. The jet regulator according to claim 1, wherein a spray plate or a sieve is provided in a water outlet opening of one of the flow chambers or flow channels to create a laminar or mousseur jet.

14. The jet regulator according to claim 1, wherein some of the water outlet openings are provided in a housing bottom of the jet regulator to create a spray jet with a number of individual jets.

15. The jet regulator according to claim 14, wherein between the housing bottom and the insert, an elastic sealing element is arranged that has tubular elements, which penetrate the water outlet openings to create a spray jet.

16. The jet regulator according to claim 1, wherein an annular valve, which is disposed rotatably or slidably along a housing of the jet regulator, is provided as a mechanical actuating element.

17. The jet regulator according to claim 1, wherein the elastic valve body has two lips or flaps that extend from a base portion, such that the two lips or flaps and the base portion form a Y-shape in cross-section.

18. The jet regulator according to claim 17, wherein a bottom portion of the insert directly contacts the base portion of the elastic valve body.

19. The jet regulator according to claim 17, wherein deformation of a first one of the two lips or flaps controls closing and opening of a first one of the flow chambers or flow channels and deformation of a second one of the two lips or flaps controls closing and opening of a second one of the flow chambers or flow channels.

20. The jet regulator according to claim 1, wherein the insert is non-movable during deformation of the elastic valve body.

* * * * *